US012201168B2

(12) United States Patent
Wong

(10) Patent No.: US 12,201,168 B2
(45) Date of Patent: Jan. 21, 2025

(54) GARMENT WITH INTEGRATED BREASTFEEDING PAD HOLDING APPARATUS

(71) Applicant: Jennifer Tam Wong, San Francisco, CA (US)

(72) Inventor: Jennifer Tam Wong, San Francisco, CA (US)

( * ) Notice: Subject to any disclaimer, the term of this patent is extended or adjusted under 35 U.S.C. 154(b) by 0 days.

(21) Appl. No.: 18/228,735

(22) Filed: Aug. 1, 2023

(65) Prior Publication Data

US 2024/0041139 A1 Feb. 8, 2024

Related U.S. Application Data

(60) Provisional application No. 63/394,432, filed on Aug. 2, 2022.

(51) Int. Cl.

| | |
|---|---|
| ***A41C 3/04*** | (2006.01) |
| ***A41D 1/215*** | (2018.01) |
| *A41C 3/08* | (2006.01) |

(52) U.S. Cl.

CPC ..... *A41D 1/215* (2018.01); *A41C 3/08* (2013.01)

(58) Field of Classification Search

CPC ..... A41D 1/215; A41C 3/08

See application file for complete search history.

(56) References Cited

U.S. PATENT DOCUMENTS

| | | | | | |
|---|---|---|---|---|---|
| 3,807,412 | A * | 4/1974 | Connelly | A61F 2/52 | 623/7 |
| 3,878,568 | A * | 4/1975 | Connelly | A61F 2/52 | 623/7 |
| 4,019,209 | A * | 4/1977 | Spence | A61F 2/52 | 450/55 |
| 4,074,721 | A * | 2/1978 | Smits | A61F 13/141 | 604/377 |
| 4,080,416 | A * | 3/1978 | Howard | A41C 5/005 | 264/258 |
| 4,125,114 | A * | 11/1978 | Repke | A61F 13/141 | 604/385.07 |
| 4,193,404 | A * | 3/1980 | Repke | A61F 13/141 | 604/385.07 |
| 4,217,905 | A * | 8/1980 | Atwater | A41C 3/0057 | 450/74 |
| 5,017,174 | A * | 5/1991 | Gowrylow | A61F 13/141 | 450/37 |
| 5,293,655 | A * | 3/1994 | VanWinkle | A47D 9/016 | D6/390 |
| 5,603,653 | A * | 2/1997 | Hartman | A41B 9/12 | 450/56 |
| 5,690,537 | A * | 11/1997 | Kalmus | A41C 3/10 | 450/55 |
| 5,931,717 | A * | 8/1999 | Lidji | A61F 13/141 | 2/104 |

(Continued)

*Primary Examiner* — Robert H Muromoto, Jr.

(74) *Attorney, Agent, or Firm* — The Rapacke Law Group, P.A.; Andrew S. Rapacke

(57) ABSTRACT

A garment having an integrated breast pad holding apparatus used when lactating is disclosed. The garment includes a first fabric set sewn to a second fabric set to form a breast pad holder for a breast pad for each breast. The breast pad holder, one for each breast, is sewn to a fourth fabric having an elastic band. A wearable garment is attached to the fourth fabric at two or more sewn regions.

19 Claims, 7 Drawing Sheets

(56) References Cited

U.S. PATENT DOCUMENTS 6,039,629 A * 3/2000 Mitchell ..... A61F 13/141 450/37
6,224,458 B1 * 5/2001 Chen ..... A41C 3/10 450/38
6,231,423 B1 * 5/2001 Deal ..... A41C 3/144 450/38
6,257,951 B1 * 7/2001 DeMarco ..... A41C 3/10 450/55
6,443,805 B1 * 9/2002 Kirkwood ..... A41C 3/08 450/57
6,676,645 B1 * 1/2004 Bitterhof ..... A61L 15/28 604/385.07
7,048,606 B1 * 5/2006 Martinet ..... A41C 3/144 450/54
7,455,567 B2 * 11/2008 Bentham ..... A41C 3/144 450/57
7,815,487 B2 * 10/2010 Warren ..... A41C 5/00 450/39
8,226,452 B2 * 7/2012 Hendrickson ..... A41C 3/04 2/104
8,469,769 B2 * 6/2013 Hendrickson ..... A41F 15/002 450/33
9,022,833 B2 * 5/2015 Deming ..... A41D 13/1245 450/30
2002/0096811 A1 * 7/2002 Callsen ..... F16F 9/306 267/143
2004/0016039 A1 * 1/2004 Caprio ..... A41C 3/08 450/36
2005/0028243 A1 * 2/2005 Polzin ..... A41C 3/08 2/104
2005/0164602 A1 * 7/2005 Armstrong ..... A41C 3/0057 450/57
2006/0277948 A1 * 12/2006 Sorensen ..... A41D 1/215 66/1 R
2007/0249263 A1 * 10/2007 Itzhak ..... A41C 3/08 450/32
2008/0003922 A1 * 1/2008 Hori ..... A41C 3/0057 450/54
2008/0076324 A1 * 3/2008 Liu ..... B29C 45/14778 450/39
2008/0125012 A1 * 5/2008 Gransberry ..... A41C 3/144 450/64
2008/0153387 A1 * 6/2008 Liu ..... A41C 3/144 450/39
2008/0153388 A1 * 6/2008 Liu ..... A41C 3/00 450/39
2008/0312616 A1 * 12/2008 Nixon ..... A41D 27/133 604/387
2009/0036022 A1 * 2/2009 Tolliver ..... A41C 3/08 2/104
2009/0186189 A1 * 7/2009 White ..... D04H 1/492 428/196
2009/0312731 A1 * 12/2009 Steindl ..... D01F 2/00 977/773
2010/0022163 A1 * 1/2010 Widell ..... A41C 3/144 450/39
2010/0031418 A1 * 2/2010 Op't Hof ..... A41C 3/08 2/113
2010/0121300 A1 * 5/2010 Hann ..... A61F 13/141 604/385.07
2010/0180358 A1 * 7/2010 Drummond ..... A41D 7/00 2/244
2011/0124267 A1 * 5/2011 Op't Hof ..... A41B 9/06 2/113
2012/0149278 A1 * 6/2012 Liu ..... A41C 3/144 450/57
2012/0297545 A1 * 11/2012 Essers ..... A47C 27/005 5/691
2012/0324651 A1 * 12/2012 Essers ..... A47C 31/006 5/691
2013/0122780 A1 * 5/2013 McCall ..... A41C 3/10 450/36
2013/0232661 A1 * 9/2013 Huntley ..... A41D 1/215 2/104
2015/0335497 A1 * 11/2015 Montford ..... A61F 13/141 604/385.14
2016/0206007 A1 * 7/2016 Op't Hof ..... A41C 3/08
2018/0000168 A1 * 1/2018 Alva ..... A41D 1/215
2019/0364980 A1 * 12/2019 Lin ..... A61M 27/00
2019/0364982 A1 * 12/2019 Hinnershitz ..... A41C 3/04
2020/0085113 A1 * 3/2020 Rendone ..... A41C 3/10
2020/0146364 A1 * 5/2020 Holdaway ..... A41C 3/14
2020/0337938 A1 * 10/2020 Kumar ..... A41C 3/04

* cited by examiner

GARMENT WITH INTEGRATED BREASTFEEDING PAD HOLDING APPARATUS

CROSS-REFERENCE TO RELATED APPLICATIONS

The present application claims priority to U.S. Provisional Application No. 63/394,432 filed Aug. 2, 2023, titled "GARMENT WITH INTEGRATED BREASTFEEDING PAD HOLDING APPARATUS" which is hereby incorporated by reference in its entirety.

TECHNICAL FIELD

The embodiments generally relate to a garment with integrated breast pad holders.

BACKGROUND

Breastfeeding breast pads shift inside garments due to human movement, fit of the garment, or fabric of the garment which does not allow the breast pad to stay in place and function as intended. A breast pad is placed over the nipple to absorb any leaking milk. Breast pads are usually placed between the nipple and a bra or article of clothing. The movement of the breast pads is uncomfortable for the wearer due to the breast pads shifting to a part of the body where it is not wanted. In addition, discomfort is caused by clothes being wet from breastmilk on the body due to a shifted breast pad(s).

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments described herein provide a garment having an integrated breast pad holding apparatus used when lactating. The garment includes a first fabric set sewn to a second fabric set to form a breast pad holder for each breast. The breast pad holder is sewn to a fourth fabric having an elastic band, wherein the fourth fabric is configured as a garment. A wearable garment is attached to the fourth fabric at two or more sewn regions. The embodiments described herein will hold the breastfeeding breast pads in place on the nipple, allowing the breast pads to be effectively used for their intended purpose, to absorb any breastmilk leakage from the nipple.

In the current arts, there has not been a way to ensure the breastfeeding breast pad stays in the same place you originally put it so the breast pad can do the job the breast pad was intended for. Some women put breast pads in their bras or in form-fitting garments to try to keep them in place, but the breast pad will most likely shift due to bodily movement and a lack of components within the bra to keep breast pads from moving. The breast pad holders will also provide the wearer the option to not wear a bra if the intention of wearing a bra was to help keep breast pads in place.

Some women put breast pads in bras to keep the breast pads in place or just placed inside a tight-fitting shirt or garment without any undergarments, but it is likely that the breast pad will shift if being kept in place these ways as the breast pads will likely move with bodily movement and due to gravity, which would result in stains and wetness on clothing from leaked milk and possible unwanted exposure of the breast pads to others while wearing them. Leakage of breastmilk onto a shirt due to a shifted breast pad may also cause milk stains on parts of shirts that the wearer does not want others to see. Besides different types of bras or tight-fitting clothing, which are not effective methods, there is no other mechanism to keep the breast pads in place.

The breast pad holders will keep breast pads in place over the nipples within the garment with the creation of the pocket made with the first fabric set and second fabric set, and the pocket being attached to a fabric that will be form-fitting over the breasts. Having the breast pads securely in place will allow the breast pads to work as intended by absorbing leaking breast milk from the nipples. Having the breast pads securely in place also avoids any discomfort from breast pads shifting to an unwanted location such as above a bra, falling to a location within the outer garment that is not over the breast nipples. Each of the layers have a purpose (detailed herein) and resolve issues of unwanted stains on exterior clothing that may be seen by others, remove discomfort caused by presence of unwanted stains and wetness, help the wearer to stay dry and comfortable.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
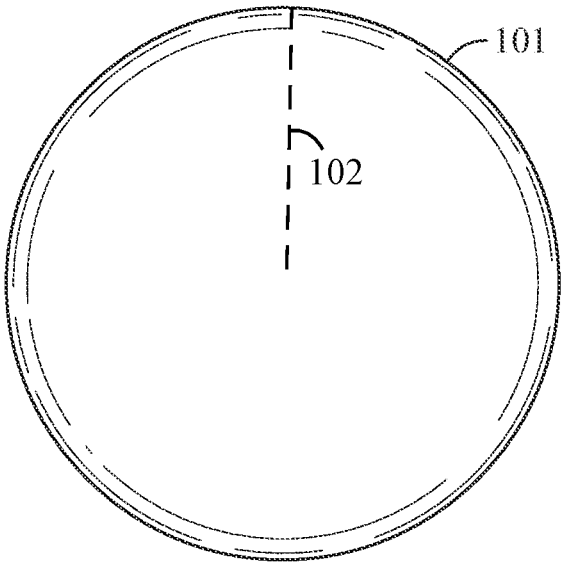
FIG. 1 illustrates a front elevation view of 'Fabric Set 2' of the breast pad holder having a flat surface, according to some embodiments.

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used to distinguish one entity or element from another entity or element without necessarily requiring or implying any physical or logical relationship, or order between such entities or elements.

In general, the embodiments described herein relate to a garment having integrated breastfeeding breast pad holders where breast pads are held in place on the nipple, allowing the breast pads to effectively absorb breastmilk leakage from the nipple. The embodiments aid in maintaining the breast pads in a suitable position to remove the likelihood that a breastfeeding woman will have stained, damp or drench clothing from leaked breastmilk and unintended exposure of their breast pads to others. This results in increased cleanliness, possible greater longevity of the breastfeeding clothing worn, avoids unwanted embarrassment from breast pad exposure, and avoids unsightly and uncomfortable breast milk stains seen on their clothing.

Various fabrics may be used for the breastfeeding breast pad holders described herein. In one example, a first fabric may be a moisture-wicking and anti-odor carbon cotton layer. A second layer may be a microfiber super-absorbent and moisture-lock layer. A third layer may be a Polyurethane Laminate (PUL) leak-resistant exterior layer (fabric side facing the skin). In some embodiments, a cotton and spandex fabric blend may be used for one or more of the first fabric layer, the second fabric layer, and the third fabric layer.

An elastic band may be positioned around the torso of the user and positioned underneath the breasts to aid with maintaining the apparatus in a suitable position. The elastic band is attached to an inner garment, such as a sports bra, tank top or similar garment worn on the upper body. In some embodiments, a cotton and spandex fabric blend may be used for the fabric of the garment.

Figure 2:
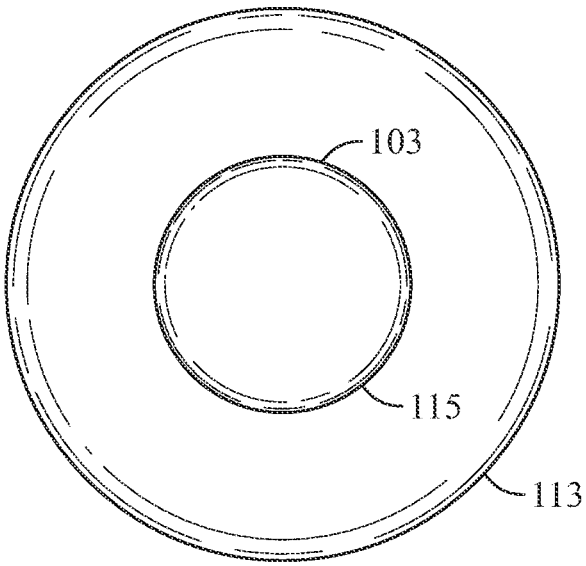
FIG. 2 illustrates a front elevation view of 'Fabric Set 1' of the breast pad holder having a flat surface and an inner circle cut in the middle through all the layers of 'Fabric Set 1', according to some embodiments.
Figure 3:
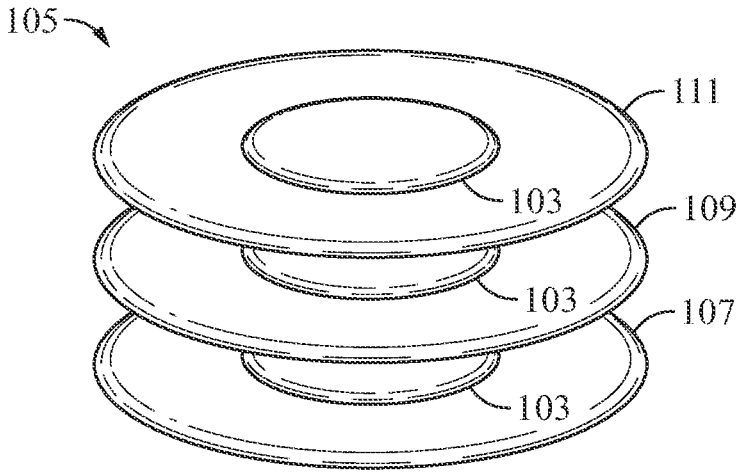
FIG. 3 illustrates an exploded perspective view of the inner sides of the corresponding layers of 'Fabric Set 1' that is comprised of the first fabric layer, the second fabric layer, and the third fabric layer, according to some embodiments.
Figure 6:
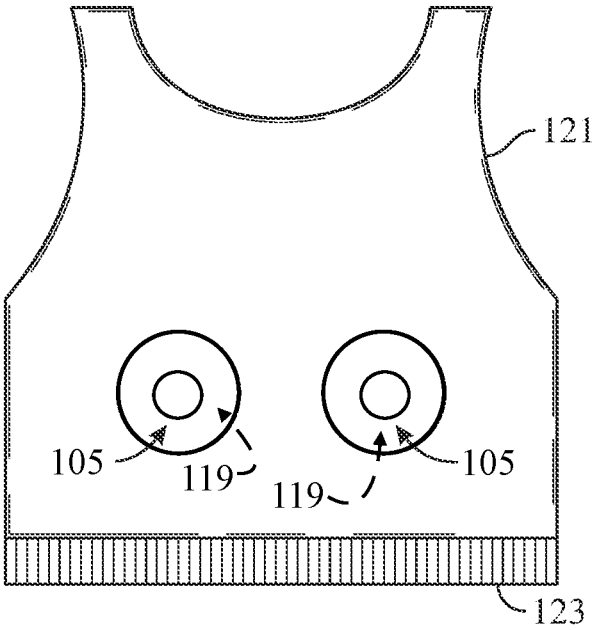
FIG. 6 illustrates a front elevation view of the side of the garment touching the front of the body and breastfeeding pads engaged with the garment where the breastfeeding pads are within the breast pad holders, according to some embodiments.

FIG. 1 illustrates the front view of 'Fabric Set 2' of the breast pad holder which has a flat circular shape 101. FIG. 2 illustrates the front view of 'Fabric Set 1' of the breast pad holder where an inner circle 103 is cut out from the center of a flat circular shape the same size as in FIG. 1. The circumference of the inner circle is equidistant from the circumference of the outer circle 113 (see FIG. 2). FIG. 1 and FIG. 2 are 2 separate pieces that a breast pad would be placed between. FIG. 3 illustrates a first fabric set 105 including a first fabric 107, a second fabric 109, and a third fabric 111. Each of the first, second, and third fabrics 107, 109, 111 are first cut into a flat circle, the size of the outer circles is slightly larger than a standard size round breast pad allowing the outer border of the fabric circles just cut to be sewn onto another piece of fabric and the breast pad to fit snuggly and securely within the pocket it is to create. A circle is cut out of each of the first fabric set's fabrics 107, 109, 111 and to a size that will securely hold standard size round breast pads (see 113 in FIG. 2). For all three circles just cut, cut another circle 103 within each of the 3 circles where the circumference of the inner circle is the same distance from the outer border of the outer circle 113 (as shown in FIG. 2). The distance from the outer circle border 113 to the inner circle border 115 will be wide enough to hold the breast pad in place and not fall out of the inner circle 103. An opening created by the inner circle cut out 103 allows the breast pad to touch the bare breast and nipple where the breast pad can absorb any breast milk leaking from the nipple. FIG. 6 is the view of the inside of the inner garment touching the front of the body. Each fabric 107, 109, 111 for 'Fabric Set 1' is cut in the just noted fashion (i.e., Circular shape with a center circle cut out) as shown in FIG. 2. The second fabric 109 is to be placed on top of the first fabric 107. The third fabric 111 is then placed on the second fabric 109. The first fabric 107 is positioned nearmost the side touching the breast. After each piece of fabric 107, 109, 111 are laid on top of each other, they are secured together by sewing with thread along the outer circle border 113. Then, the inner circle border 115 is sewn. The entire above paragraph is performed twice so there is a first fabric set 105 for each breast.

In some embodiments, and in further reference to FIG. 1, a dart 102 is provided on one or more layers of the fabric sets. The dart 102 may be added to assist with the pockets curving to the shape of the breast for a better fit and aesthetic. One skilled in the arts will readily understand that the dart 102 may be constructed using various methods known in the arts.

In some embodiments, the first, second, and third fabric layers each include a dart to ergonomically shape the breast pad holders to conform to the user's anatomy. The darts may be 'sewing darts' positioned in various positions on the layers of fabric set 1 and fabric set 2 (e.g., at the side, top or bottom of the pads).

Figure 4:
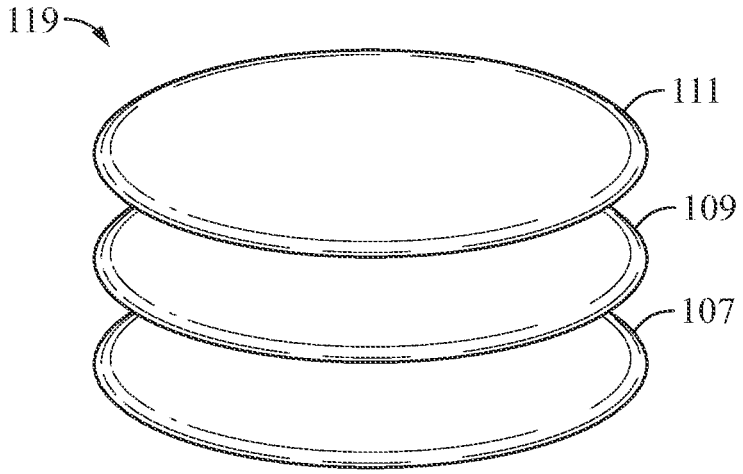
FIG. 4 illustrates an exploded perspective view of the inner sides of the corresponding layers of 'Fabric Set 2' that is comprised of the first fabric layer, the second fabric layer, and the third fabric layer, according to some embodiments.

In reference to FIG. 4, a second fabric set 119 is cut having a circle cut from each of the fabric 107, 109, 111. The circles are cut to have the same circumference as the outer circle border 113 as described in FIG. 2, but with no inner circle being cut out. The second fabric 109 circle will be placed on the first fabric 107 circle and the third fabric 111 will be placed on the second fabric 109 circle forming a 3-layered circle. The first fabric 107 will be facing nearmost the side facing the breast behind fabric 111 of the first fabric set. After each fabric 107, 109, 111 is laid on top of each other as described above, the fabric 107, 109, 111 are secured together by sewing with thread along the circumference of the outer circle border 101. The entire above process is performed twice so there is a second fabric set 119 for each breast.

Figure 5:
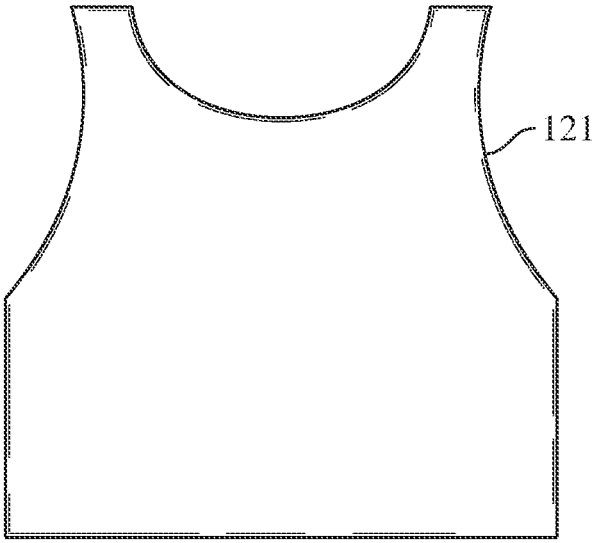
FIG. 5 illustrates a front elevation view of the fourth fabric shaped as a garment, according to some embodiments.

FIG. 5 illustrates a front elevation view of the fourth fabric 121 (using a fabric such as, but not limited to, a cotton spandex blend) which is cut in shape of a garment, such as but not limited to a sports bra-like type shape, where the bottom of the shape will land right underneath the breasts. Another piece in the shape similar to a garment as illustrated in FIG. 5 are cut. The shape in FIG. 5 may vary but must be able to fit a fabric set for each breast (i.e., both breast pad pockets) as well as an elastic band 123 (see FIG. 6) to be attached at the bottom of the shape. With one of the garment shapes FIG. 5, place the second fabric set 119 onto the inside of the fourth fabric 121 (i.e., the side facing the breasts). The second fabric set 119 is placed onto the inside of the fourth fabric 121 for each breast where each breast would be when the garment is worn. The third fabric 111 of the second fabric set 119 is touching the fourth fabric 121. The center of the circles in second fabric set 119 is to be placed where the breast nipples would be when the fourth fabric 121 is worn over the breasts. Next, the circles are attached to the fourth fabric 121. In some embodiments, the circles are sewn with thread around the circumference of the circles onto the fourth fabric 121.

Figure 7:
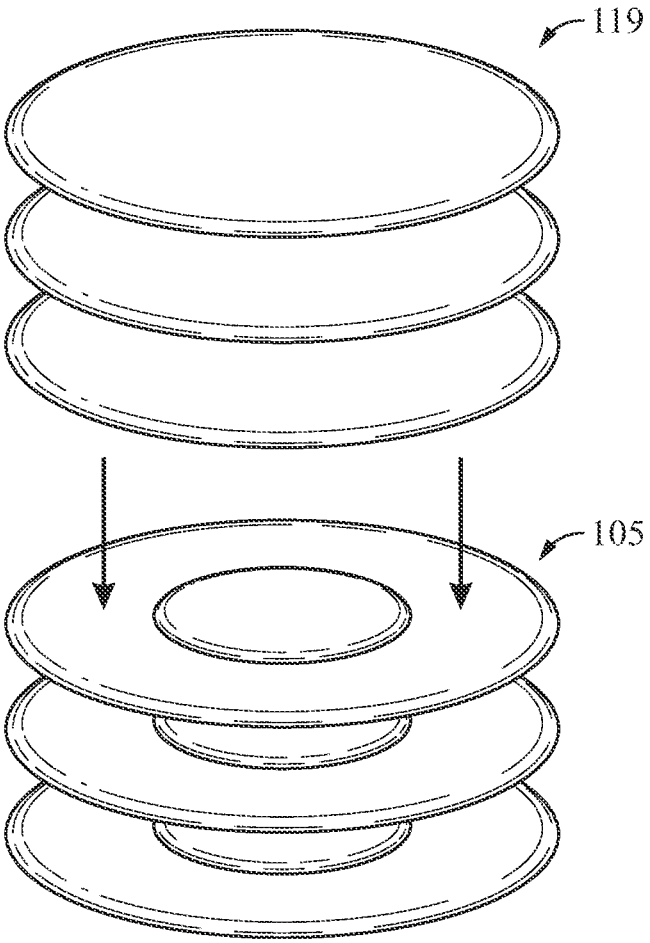
FIG. 7 illustrates an exploded view of the breastfeeding pad holder/pocket, according to some embodiments.
Figure 8A:
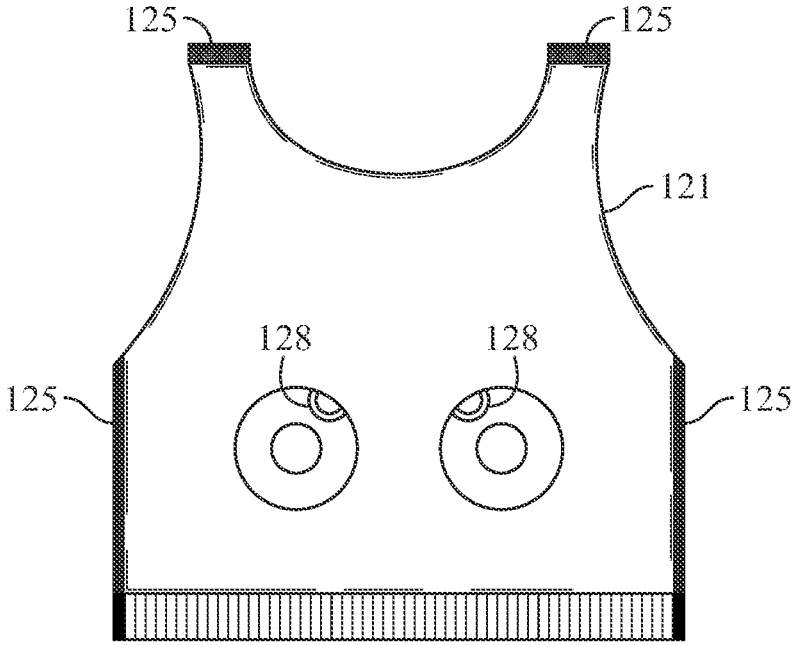
FIG. 8A illustrates a front elevation view of the side of the garment touching the front of the body, according to some embodiments.

The first fabric set 105 is then placed directly on top of each of the fabrics 107, 109, 111 of the second fabric set 119 as shown in FIG. 7. Fabric 111 of the first fabric set 105 may be touching fabric 107 of the second fabric set 119. The first fabric set 105 and second fabric set 119 are sewn together at the circumference of the outer circles with the thread leaving an opening 128 at the outer circle's circumference so that a breast pad can be placed through the opening 128 (See FIG. 8A), an opening large enough to place the breast pad by hand but not to allow the breast pad to come out of the opening 128 as shown in FIG. 8A.

The two pieces of the fourth fabric 121 are then put on top of each other where the shapes are aligned directly on top of the other. The first fabric set 105 and second fabric set 119 are in between the two pieces of the fourth fabric cut outs. The fourth fabric 121 shapes are to be sewn together at the top (shoulders) 125 and at the sides 125 (see FIG. 8A). An elastic band 123 is then sewn into the entire bottom inside edge of the fourth fabric 121 as seen in FIG. 6. The elastic band 123 will be sewn approximately an inch away from the bottom of the fourth fabric 121 shape to allow the fabric at the bottom of the shape cut-out to be folded over the elastic band 123 (on the inside) and sewn right above the elastic band 123 so that the elastic band 123 is concealed. Once the fourth fabric shapes 121 are sewn together and the elastic band 123 is sewn in, it should fit snug over the breasts when worn.

In some embodiments, the elastic band may be sewn or otherwise attached to the inside of the bottom of the fourth fabric where the bottom of the elastic and the bottom of the fourth fabric align with one another. In another embodiment, the elastic band may not be concealed and a plush back elastic band with the plush side facing toward the skin may be used.

In some embodiments, the elastic band may be sewn or otherwise attached to the bottom edge of the fourth fabric where the top of the long edge of the elastic band and the bottom of the fourth fabric align with one another. In another embodiment, there may be a portion of overlap between the long edge of the elastic band and the bottom edge of the fourth fabric when sewn or otherwise attached together. In the above two embodiments, the elastic band (shorter width) ends may be attached together by being sewn after the elastic band is attached to the fourth fabric.

In some embodiments, the fourth fabric, with the breast pad pockets engaged/positioned therein, may be connected to the outer garment in areas other than the neckline and armholes.

In some embodiments, the fourth fabric, with the breast pad pockets engaged/positioned therein, may not be connected to an outer garment.

Figure 8B:
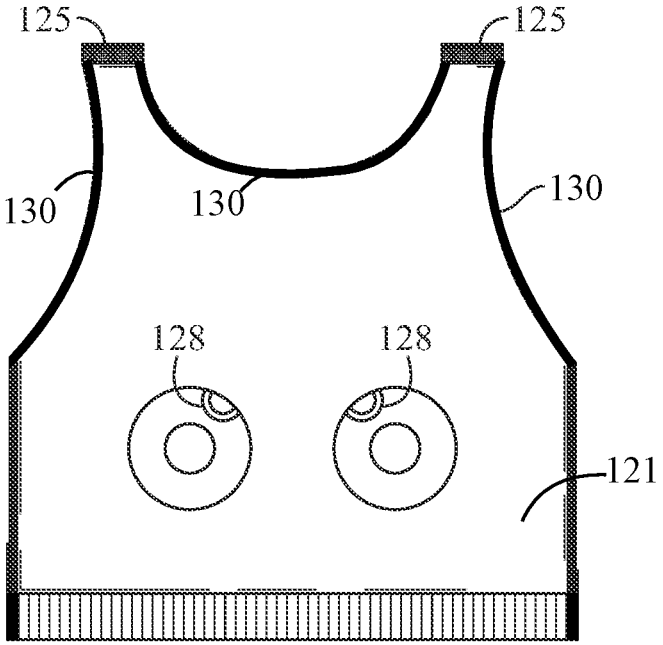
FIG. 8B illustrates a front elevation view of the side of the fourth fabric touching the front of the body, to illustrate a means for attaching the fourth fabric to the outer garment, according to some embodiments.
Figure 9:
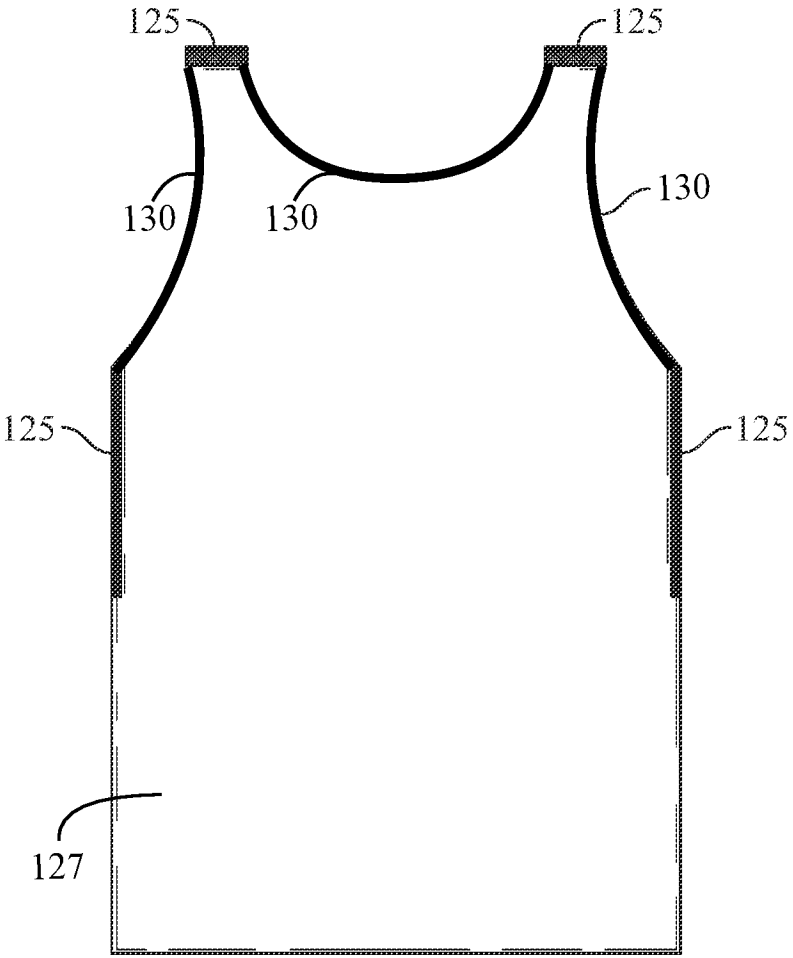
FIG. 9 illustrates a front elevation view of the outer garment when facing someone who is not wearing the garment, that the breast pad holders are sewn within according to some embodiments.

After the fourth fabric 121 shapes are sewn together and the elastic band 123 is sewn in, it now serves as a secure holder for the breast pads covering the nipples of each breast. The entire neckline and armhole border regions 130 in FIG. 8B are then sewn into the inside of a garment 127 such as a standard tank top at regions 130 (as shown in FIG. 9). The border of the neckline of the fourth fabric are sewn to the border of the neckline of the outer garment. Further, the border of the armholes of the fourth fabric are sewn to the respective armholes of the outer garment.

Figure 10:
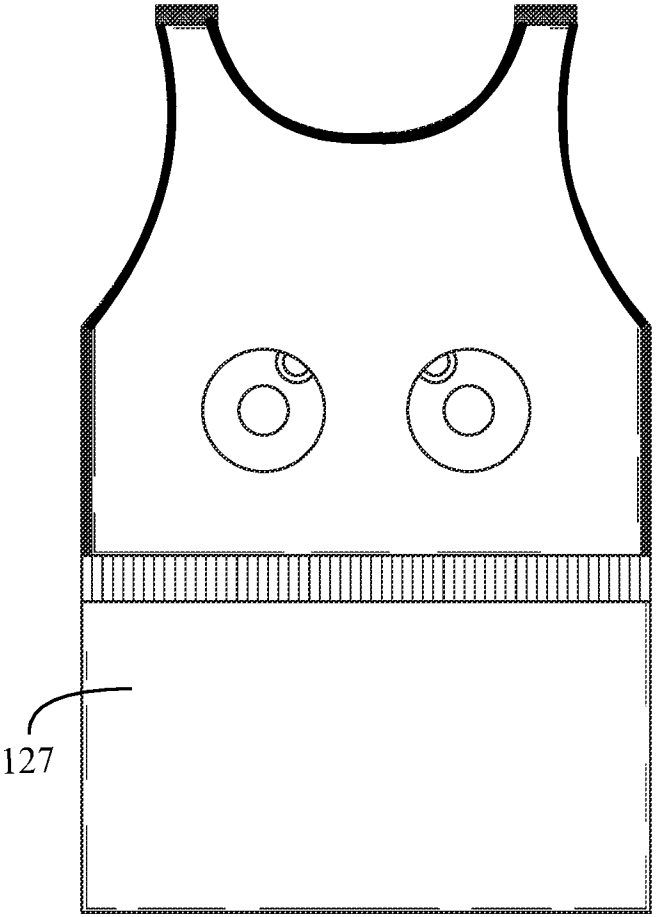
FIG. 10 illustrates a front elevation view of the outer garment with the elements of the breast pad holder sewn in, this view is the view of the side of the garment that is touching the front body of the wearer, according to some embodiments.

Once the breast pad holders are sewn into a wearable garment 127 (see FIG. 10), an individual would then put on the wearable garment 127 by placing the ring made by the elastic band 123 over their head and put their arms through the arm holes of the garment 127. The elastic band 123 would be positioned flat under the breast area and the center of the holders (inner circles) of each holder would be positioned on top of the nipples of the breasts. The user should ensure the breast pad pockets are snug over the breasts which is achieved by the form fitting nature of the fabric the breast pad pocket and elastic band are sewn to. The elastic band 123 will assist with the snug fit, help to support the breasts and keep the breast pads in place.

Once worn, the inner circles of the breast pad holder lie in a position that is snug over the breasts and completely covers the breast nipple so that when a breast pad is placed in the holder, the breast pad itself is touching the nipple so it can absorb any milk coming from the nipple. An individual would then place a breast pad into her right hand, pull the top opening of the tank top (garment) away from her breast with her left hand to open the tank top enough to place the breast pad in, squeeze the breast pad together slightly to fit into the opening 128 (see FIG. 8A) at the outer circumference of the breast pad holder for the left breast, then once the breast pad is completely inside the breast pad holder, flatten the breast pad inside the holder so the outside border of the breast pad, when laid flat, is now in between the first fabric set 105 and the second fabric set 119 and touching or very close to the thread line along the outer circle's circumference. Once the breast pad is laid flat within the holder and the portion of the breast pad in the inner circle is touching the bare breast, the left breast pad is now secure to absorb any breastmilk from the nipple.

The individual would then place a breast pad into her left hand, pull the top opening of the tank top (garment) away from her breast with her right hand to open the tank top enough to place the breast pad in, squeeze the breast pad together slightly to fit into the opening 128 (see FIG. 8A (view is the side of the garment touching the body)) at the outer circumference of the breast pad holder for the right breast, then once the breast pad is completely inside the breast pad holder, flatten the breast pad so the outside border of the breast pad, when laid flat, is now in between the first fabric set 105 and the second fabric set 119 and touching or very close to the thread line along the outer circle's circumference. Once the breast pad is laid flat within the holder and the portion of the breast pad in inner circle is touching the bare breast, the right breast pad is now secure to absorb any breastmilk from the nipple.

In some embodiments, the first fabric 107 (in FIG. 3, 107 is the fabric touching the breast) may use a moisture-wicking and anti-odor carbon fabric such as Cotton (or Modal and Spandex). This layer is intended to be comfortable, keep the wearer dry and avoid any foul odor from the breastmilk. This layer will wick any moisture or breastmilk away from the breast nipple and on the breast to keep the wearer comfortable.

The second fabric 109 may use a super-absorbent and moisture-locking fabric like microfiber. This layer is intended to absorb and lock-in any moisture from the first fabric 107 and could absorb any moisture that the breast pad may have not absorbed or any excess moisture from the breast pad itself, so the wearer feels dry and comfortable.

The third fabric 111 may use a leak-resistant and waterproof fabric such as nylon, polyester or PUL (Polyurethane Laminate). This layer is intended to keep the middle super-absorbent layer from leaking any moisture it has absorbed onto the outer garment.

The second fabric set 119 adds a further level of protection to avoid leakage and stains. The second fabric set 119 uses the same fabric types as described above.

In some embodiments, once the breast pads are soiled to a level that is uncomfortable to the wearer, the breast pads are taken out through the same openings 128 (at the outer circumference) they were put in and replaced by repeating the steps above with clean breast pads.

In some embodiments, the garment includes a finished neckline having mobilon tape (or similar material) at about ¼-inch in dimension. The neckline may be constructed having a soft square shape. Finished armholes may also be constructed in a similar manner using ¼-inch mobilon tape. The mobilon tape provides a durable material that can be repeatedly stretched through use of the garment (such as when breastfeeding), while assisting the garment in retaining its original intended fit.

In some embodiments, the garment includes an area supporting the breasts within the garment having the absorbent and/or protective materials positioned therein. The area supporting the breasts, which may be a bra, may be designed for support and to hold the nursing/breast pads in position. The absorbent and/or protective materials may be attached to the garment with an opening to permit selective pad removal or inputting of the pad.

In some embodiments, the device include absorbent breast pads with a sewn dart for shaping to conform to the breasts of the wearer. The darts may be positioned in various positions on the layers of the absorbent breast pad (e.g., at the side, top or bottom of the pads).

In some embodiments, the first fabric layer of the breast pad contacts the user's skin via a circle cutout in fabric set 1. The material of the first fabric layer may be a soft fabric such as cotton, cotton French terry, or a similar fabric. The terry loops may be oriented to face the user's skin. The second fabric layer (i.e., the middle fabric layer) may be constructed of a microfiber terry fabric or similar quick-dry and absorbent fabric known in the arts. The terry loops of the second fabric are oriented to face the first layer. The third layer is construed of a polyester tricot fabric or similar fabric known in the arts which are water resistant. In some embodiments, the fabric of the third layer includes a water resistant coating which is oriented to face toward the second layer.

In some embodiments, each fabric layer of the breast pad is the same shape and size and configured to nest on top of one another where the outer border of each fabric layer align. A stitch may be provided around the border to connect each of the first, second and third layers of the pad to connect them into a singular piece. This maintains the layers in position during use.

One skilled in the arts will readily understand that the garment may be constructed using various known materials and be fashioned having various designs, colors, and other ornamental items.

The shape of the pockets and/or the pads may be configured in a circular shape, oval shape, or other shape to provide absorbent properties while lactating or before and after breastfeeding. Further, the pockets and/or pad configuration may assist with proper fit, coverage, and/or support during use.

The layer of the fabric set that touches the sports bra-like portion may be a polyurethane foam molded bra cup (approx. 1/16" thickness) for molded support and to help conceal bumps for smooth appearance on the outside/outer garment. There may be a water-resistant coating applied on one side of the polyurethane foam molded bra cup (the side facing the body).

The polyurethane foam molded bra cup is expected to minimize the imprint (i.e., the pocket and pad being seen) of the pocket and pad when the garment is worn due to its foam/padding/stable material as the remaining pocket layers are fabrics which are not stable and may wrinkle or crease when worn, whereas the bra cup is stable and should not wrinkle.

In some embodiments, the middle layer of the pocket sets include a super-absorbent and/or quick-drying material (such as those known and used in the arts). This may allow for efficient drying of the material rather than a material which locks in moisture.

In some embodiments, the elastic band may not be concealed or covered, but rather provided as an elastic element having a backing facing towards the skin.

In some embodiments, the Mobilon tape may be utilized where it is encased in the neckline, armholes, and shoulder seams of the garment. The Mobilon tape may be sufficiently stretchy and stretches with the fabric to provide comfort during use. In addition to recovery, it also minimizes the risk of the seam/stitches popping open when stretched.

In some embodiments, a dart is provided on one or more layers of the fabric sets. The dart may be defined as a pleated portion of fabric that lends a natural, three-dimensional shape to a flat design when sewn into fitted garments. The 'dart' or 'sewing dart' is added to assist with the pockets curving to the shape of the breast for a better fit.

Materials used for the garment may include, by way of example, any of the following: nylon, spandex, poly thread, elastic materials, elastic bands, Mobilon tape, cotton, tricot fabric, polyester blends, polyester, and other materials and blends known in the arts. Similarly, materials used for the breast pad holder and breast pad may include various "plush" materials to provide comfort and absorption. For the breast pad holder, the materials may include polyurethane foam. The polyurethane foam may be molded in a curved (conical may be referring to a dome-like shape) and ergonomic shape to provide comfort and support of the breast shape.

Other items from other industries can be put into the breast pad holder. The holder for breast pads can have a multitude of uses including, but not limited to, being used in the medical industry. For example, the holder for breast pads could be used for holding medical pads over the breasts such as heat or cold pads or pads with a medicinal component.

Many different embodiments have been disclosed herein, in connection with the above description and the drawings.

It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A garment having an integrated breast pad for lactating, comprising:

a first fabric set sewn to a second fabric set to form a breast pad holder for a breast pad for each breast, the breast pad holder sewn to a fourth fabric;

an elastic band sewn to a bottom of the fourth fabric; and a wearable garment to attach to the fourth fabric at two or more sewn regions, wherein:

the fourth fabric shaped as a garment configured to hold the integrated breast pad;

any of the first and second fabric sets has a cut out in a center to allow the breast pad to touch the breast and a nipple to absorb fluid from the breast; and wherein the opening is positioned at the outer edge where two fabric sets are sewn together and the opening is configured to allow the breast pad to be placed into a pocket by hand.

2. The garment having an integrated breast pad holding apparatus of claim 1, wherein the first fabric set, and second fabric set each include a first fabric.

3. The garment having an integrated breast pad holding apparatus of claim 1, wherein the first fabric is a moisture-wicking and anti-odor fabric.

4. The garment having an integrated breast pad holding apparatus of claim 1, wherein the first fabric set, and second fabric set each include a second fabric.

5. The garment having an integrated breast pad holding apparatus of claim 1, wherein the second fabric is a super-absorbent, moisture-locking fabric.

6. The garment having an integrated breast pad holding apparatus of claim 1, where in the second fabric is a quick-drying fabric.

7. The garment having an integrated breast pad holding apparatus of claim 1, wherein the first fabric set, and second fabric set each include a third fabric.

8. The garment having an integrated breast pad holding apparatus of claim 1, wherein the third fabric is a PUL leak-resistant fabric.

9. A garment having an integrated breast pad holding apparatus used when lactating, comprising:

a fabric set comprised of a first, second, and third fabric sewn to a second fabric set to form a breast pad holder for a breast pad for each breast, the breast pad holder sewn to a fourth fabric, each of the first, second, and third fabrics including a dart to provide an ergonomic shape to each layer, the first fabric comprised of a cotton and spandex blend fabric, the second layer comprised of a microfiber terry fabric, and the third layer comprised of a polyester tricot with a water resistant coating or polyurethane laminate;

a stitch positioned around a border of the first, second, and third fabrics to retain the first, second, and third layers in position during use;

an elastic band sewn to a bottom of the fourth fabric; and a wearable garment to attach to the fourth fabric at two or more sewn regions.

10. The garment having an integrated breast pad holding apparatus of claim 9, wherein the fourth fabric is shaped as a garment.

11. The garment having an integrated breast pad holding apparatus of claim 10, wherein the first fabric set, and second fabric set each include a first fabric.

12. The garment having an integrated breast pad holding apparatus of claim 11, wherein the first fabric is a moisture-wicking and anti-odor fabric.

13. The garment having an integrated breast pad holding apparatus of claim 12, wherein the first fabric set, and second fabric set each include a second fabric.

14. The garment having an integrated breast pad holding apparatus of claim 13, wherein the second fabric is a super-absorbent and moisture-locking fabric.

15. The garment having an integrated breast pad holding apparatus of claim 14, wherein the second fabric is a quick-drying fabric.

16. The garment having an integrated breast pad holding apparatus of claim 15, wherein the first fabric set, and second fabric set each include a third fabric.

17. The garment having an integrated breast pad holding apparatus of claim 16, wherein the third fabric is a PUL leak-resistant fabric.

18. The garment having an integrated breast pad holding apparatus of claim 17, wherein one of the fabric sets has a hole cut out in the center to allow the breast pad to touch the breast and nipple to absorb fluid from the breasts.

19. The garment having an integrated breast pad holding apparatus of claim 18, wherein there is an opening at the outer edge of where the two fabric sets are sewn together including an opening that allows a breast pad to be placed into the pocket by hand.

* * * * *